United States Patent [19]

Libutti et al.

[11] 4,134,729

[45] Jan. 16, 1979

[54] AQUEOUS SOLUTION OF SODIUM ALUMINATE AND N-AMINOETHYL ETHANOLAMINE AS A COLD END ADDITIVE

[75] Inventors: Bruce L. Libutti, Bethayres; Francis J. Oschell, North Hills, both of Pa.

[73] Assignee: Betz Laboratories, Inc., Trevose, Pa.

[21] Appl. No.: 831,563

[22] Filed: Sep. 8, 1977

Related U.S. Application Data

[63] Continuation of Ser. No. 713,729, Aug. 12, 1976, abandoned.

[51] Int. Cl.[2] ..... C23F 11/00; C23F 11/02

[52] U.S. Cl. ..... 422/9; 110/343; 110/345; 252/389 R; 423/242; 423/243; 423/244

[58] Field of Search ..... 21/2.5 B; 423/243, 244, 423/242; 110/1 J, 1 K, 343, 345; 252/389 R, 392

[56] References Cited

U.S. PATENT DOCUMENTS

| | | | |
|---|---|---|---|
| 2,106,446 | 1/1938 | Baehr et al. | 423/243 X |
| 2,155,853 | 4/1939 | Anthony | 423/243 X |
| 2,972,861 | 2/1961 | Davies | 21/2.5 B UX |
| 3,547,583 | 12/1970 | Wilson | 423/242 |
| 3,709,977 | 1/1973 | Villiers-Fisher | 423/244 |
| 3,809,745 | 5/1974 | Wilson | 423/244 |
| 3,856,921 | 12/1974 | Shrier et al. | 423/243 X |
| 3,873,673 | 3/1975 | Teague et al. | 423/243 |
| 3,886,261 | 5/1975 | Libutti | 423/244 |
| 3,904,735 | 9/1975 | Atwood et al. | 423/243 |
| 3,932,588 | 1/1976 | Libutti et al. | 423/244 |
| 3,961,018 | 6/1976 | Williamson | 423/243 X |
| 3,962,404 | 6/1976 | Grammarco et al. | 423/243 X |

FOREIGN PATENT DOCUMENTS

| | | | |
|---|---|---|---|
| 872984 | 7/1961 | United Kingdom | 423/244 |
| 1305750 | 2/1973 | United Kingdom | 423/244 |

OTHER PUBLICATIONS

Bienstock, et al., "Process Development in Removing . . . Flue Gases;" Report #5735, Bureau of Mines, pp. 8–17.

*Primary Examiner*—Barry S. Richman
*Attorney, Agent, or Firm*—Alexander D. Ricci; Steven H. Markowitz

[57] ABSTRACT

A method of reducing the amount of sulfur trioxide condensation on, and therefore the amount of sulfuric acid corrosion of, metal parts at the cold-end of a combustion system in contact with combustion gases derived from the combustion of sulfur-containing fuel, said method comprising adding to the combustion gases an effective amount for the purpose of an aqueous solution of sodium aluminate and an alkanolamine, particularly N-aminoethyl ethanolamine.

12 Claims, No Drawings

AQUEOUS SOLUTION OF SODIUM ALUMINATE AND N-AMINOETHYL ETHANOLAMINE AS A COLD END ADDITIVE

This is a continuation of application Ser. No. 713,729 filed Aug. 12, 1976, now abandoned.

DISCLOSURE OF THE INVENTION

As is well-known to boiler operators, sulfur-containing fuels present problems not only from a pollutional point of view, i.e., acid smut, but also with respect to the life and operability of metallic equipment and parts which are in contact with the flue gases containing the sulfur by-products of combustion.

Upon combustion, the sulfur in the fuel is converted to sulfur dioxide and sulfur trioxide. When sulfur trioxide reaches its dew temperature, it reacts with moisture in the flue gas to produce the very corrosive sulfuric acid. The gases themselves are troublesome as air pollutants, while the acid formed is damaging from corrosion aspects.

As can be appreciated, the greater the sulfur content of the fuel, the more effects are harmful. This is particularly the case in industrial and utility operations where low grade oils are used for combustion purposes.

Although many additives have been utilized for the purpose of conditioning flue gases, few additives have found overall success. The reason for the relatively little success in this area is felt to be the peculiarities found in the different combustion systems and boiler designs. The gas dynamics and the loads produced, sometimes make chemical treatments for the most part impractical, therefore, requiring a combination of mechanical and chemical treatment.

It was to this problem that the present inventors addressed themselves, i.e., the problem of reducing acid smut and acid corrosion of metal parts utilizing a minimum of mechanical and chemical treatment.

The basic area to which the present invention is directed is often referred to in the industry as the "cold-end" of a boiler operation. This area is generalized as being the path in the boiler system that the combustion gases follow after the gases have, in fact performed their service of heating water, producing steam and/or superheating steam.

In the large boiler systems, the last stages through which the hot combustion gases flow include the economizer, the air heater, the collection equipment or the electrostatic precipitator, and then the stack through which the gases are discharged.

The present invention is drawn to the present inventor's discovery of a cold-end additive composition comprising an aqueous solution of sodium aluminate and an alkanolamine (or mixture of alkanolamines). It was determined that if this additive composition is fed, in liquid droplet form, to the moving combustion gases upstream of the cold-end surfaces to be treated and, preferably, at a point where the gases are undergoing turbulence, the additive will travel along with the gases as solid particles, vapor and/or as liquid droplets and will deposit on the downstream cold-end surfaces. The deposition of the additive on the cold-end surfaces results from the transition of the gas flow from a zone of relative turbulence to a zone where the turbulence subsides and/or from the lowering of the temperature of the combustion gases below the dew point temperature of the additive. In addition, additive will impact on surfaces which interrupt or constrict the gas stream.

The sodium aluminate alone can either be fed as an aqueous solution or as a dry, fine powder. When the sodium aluminate is fed alone to the combustion gases, it is possible that a portion will covert to alumina. The use of particulate alumina as a cold-end additive is disclosed in U.S. Pat. No. 3,886,261. The present inventors discovered enhanced results when they used the sodium aluminate additive as compared to the particulate alumina additive. It is believed that a different result is obtained when the sodium aluminate additive is used as compared to particulate alumina due to a substantial portion of the additive not converting to alumina. The aqueous solution is prepared by simply mixing the sodium aluminate with water. Although both solid and liquid sodium aluminate are available, the liquid form is preferred.

In three articles, a first entitled "The Selection and Use of Additives in Oil-fired Boilers", by W. D. Jarvis and appearing in the November, 1958 issue of the *Journal of the Institute of Fuel;* a second entitled "The Use of Ammonia for Reducing Air-heater Corrosion at Bankside Generating Station, C.E.G.B.", by J. T. S. Gundry, B. Lees, L. K. Rendle, and E. J. Wicks and appearing in the October, 1964 issue of *Combustion;* and a third entitled "The Use of Heterocyclic Tertiary Amines for the Control of Corrosion Caused by Flue Gases", by E. Brett Davies and B. J. Alexander and appearing in the April, 1960 issue of the *Journal of the Institute of Fuel;* the use of heterocyclic tertiary amines, obtained from the distillation of crude coal tar, as boiler cold-end additives is disclosed. Besides disclosing that heterocyclic tertiary amines inhibit boiler cold-end corrosion, the articles also point out that the use of these chemicals causes black carbonaceous deposits on cold-end surfaces, which deposits can become pasty and have a pronounced smell, apparently due to their derivation from coal tar. The present inventors have discovered alkanolamines as cold-end additives. These inventive additives do not yield black carbonaceous deposits having a pronounced smell.

As already noted, the inventive additive composition is preferably fed in droplet form to the gases. There are numerous methods for feeding the additive in droplet form, which methods are deemed within the skill of the art. For example, liquid atomizer nozzles could be used. The present inventors obtained satisfactory results using a sonic feed nozzle to produce a mist of the additive solution, even though deposits of additive formed over it. The use of a pressure atomizing nozzle system with in-line dilution and water purging should resolve any problems related to the formation of deposits on the nozzle. The size range of the liquid droplets is preferably small enough to ensure that the portion of the additive composition which does not evaporate but, instead is present in the combustion gases in liquid droplet form and particulate form, will be carried along with the gases to be deposited on the surfaces to be treated. The maximum size of the droplets and particles could be about 360 microns; however, the preferred maximum is about 260 microns. The noted size limitations are based on past experience with feeding additives at boiler system cold-ends.

The total amount of the composition required to treat the cold-end of a combustion system will vary, depending of course on the nature and severity of the problem. More specifically, the amount of additive added is a function of the sulfur content of the fuel expressed as the $SO_3$ (sulfur trioxide) produced upon combustion. The amount of aqueous sodium aluminate alone that can be added can be as little as about 0.2 pound, on an active basis, per pound of $SO_3$; the preferred minimum is about 0.25 pound of active sodium aluminate per pound of $SO_3$ generated by the combustion system. Based on economic considerations, the amount of active sodium aluminate alone fed to the combustion system could be as high as about 1.0 pound per pound of $SO_3$; however, 0.4 pound of sodium aluminate per pound of $SO_3$ represents the preferred maximum. The amount of alkanolamine alone that can be added could be as little as about 0.1 pound of alkanolamine, on an active basis, per pound of $SO_3$ generated. The preferred minimum is about 0.25 pound of alkanolamine per pound of $SO_3$. Based on economic considerations, the amount of active alkanolamine fed alone could be as high as about 1.0 pound per pound of $SO_3$; however, about 0.33 pound of alkanolamine per pound of $SO_3$ represents the preferred maximum. Accordingly, the invention composition is considered to comprise from about 0.2 to about 0.9 pound of sodium aluminate per pound of sulfur trioxide generated and from about 0.1 to about 0.8 pound of alkanolamine per pound of sulfur trioxide generated with the proviso that the total treatment level not exceed about one pound of actives per pound of sulfur trioxide generated. The maximum one pound treatment level per pound of $SO_3$ is based on economic considerations. The preferred composition is considered to comprise from about 0.25 to about 0.75 pound of sodium aluminate per pound of sulfur trioxide generated and from 0.25 to 0.75 pound of alkanolamine per pound of sulfur trioxide generated with the proviso that the total treatment level not exceed about 1.0 pound per pound of sulfur trioxide generated.

The temperature of the combustion gases at the time of addition is from about 250° F. to about 675° F., preferably from about 350° F. to about 650° F.

The inventive composition can either be mixed in situ, for example by feeding each component separately (double-barrel treatment) into a water-supply pipe to the spray nozzle(s), or the additive can be mixed before use (single-barrel treatment) and pumped directly to the spray nozzle(s) or other feeding means. When the amount of the aqueous sodium aluminate in the total composition exceeds about 35%, the in situ mixing method noted above is preferred. When the amount of aqueous sodium aluminate in the total composition exceeds about 43%, the in situ mixing method is particularly preferred.

In order to assess the efficacy of the inventive materials individually, various tests were conducted on industrial boiler systems which were fired by fuel oil containing about 2.2 percent sulfur. The ability of the individual additives to coat surfaces and to reduce acid deposition, corrosion and fouling were evaluated. Acid deposition rates at various surface temperatures were determined by titrating washings from a standard air-cooled CERL probe. The nature of the surface coating was determined by visual inspection of the probe. The washings were also analyzed for total iron and total solids content to obtain indications of corrosion rates and fouling tendencies, respectively. Using a Land meter, the rate of acid build-up (RBU) was determined.

The sodium aluminate material tested was an aqueous solution containing 43% liquid sodium aluminate ($NaAlO_2$). The additive solution was fed to the combustion gases at the cold-end of the systems using an atomizer nozzle located in the duct.

The amine tested was commercially available N-aminoethyl ethanolamine (Naeea) which was obtained from Union Carbide. The additive was mixed with water and a commercially available sodium salt of EDTA (as a stabilizer) to form an aqueous solution comprising 49.9% water, 50% Naeea and 0.1% stabilizer.

The combined treatment composition was made by simply mixing the above-described components.

In a first series of tests, hereinafter referred to as the preliminary tests, the combustion gases contained about 18 parts of sulfur trioxide per million parts of combustion gases on a volume basis.

In a second series of tests, hereinafter referred to as the confirming tests, the combustion gases contained about 55 parts of sulfur trioxide per million parts of combustion gases on a volume basis. In the confirming tests, the sodium aluminate was further diluted with three parts of water by volume.

EXAMPLE 1

As already noted, the effects of the aqueous sodium aluminate on acid deposition were determined by titrating washings from a probe similar to a standard British Central Electricity Research Laboratories (CERL) acid deposition probe. The construction and operation of this probe are well known in the art as evidenced by an article entitled "An Air-cooled Probe for Measuring Acid Deposition in Boiler Flue Gases" by P. A. Alexander, R. S. Fielder, P. J. Jackson and E. Raask, page 31, Volume 38, *Journal of the Institute of Fuel;* which is hereby incorporated by reference to indicate the state of the art. Washings from the probe were titrated for sulfuric acid with sodium hydroxide.

The results of these tests are reported below in Tables 1A and 1B in terms of acid deposition rate expressed as milliliters of 0.01N NaOH needed to titrate one fourth of the amount of acid which deposited on 18.8 square inches ($in^2$) to the phenolphthalein end point. The feedrates reported are expressed as pounds of active additive per hour, and the steam loads are also reported as pounds per hour. The % $O_2$ reported is the oxygen content of the combustion gases on a % volume basis. Table 1A contains the results of the preliminary tests, and Table 1B contains the results of the confirming tests. In the preliminary tests, the acid deposition rates at 220° F. were determined, while in the confirming tests the determinations were for acid deposition at 230° F. and 250° F. In the preliminary tests, the probe was exposed to the combustion gases for 30 minutes; while in the confirming tests the probe was exposed for the time period indicated. Any ranges reported simply indicate a change in reading during a measurement, which is a common occurrence in this art.

TABLE 1A

| Additive | Feedrate (pph) | Steam Load (pph × $10^3$) | % $O_2$ | Acid Deposition 220° F |
|---|---|---|---|---|
| None | — | 70–71 | 2.6 | 11.0 |
| None | — | 70–71 | 2.6 | 11.0 |
| None | — | 70–71 | 2.6 | 11.0 |
| None | — | 70 | 2.9 | 10.0 |
| $NaAlO_2$ | 4.3 | 70 | 2.9 | 5.5 |

TABLE 1B

| Additive | Exposure Time (hrs) | Feedrate (pph) | Steam Load (pph × $10^3$) | % $O_2$ | Acid Deposition 230° F | 250° F |
|---|---|---|---|---|---|---|
| None | 0.5 | — | 100–110 | 2.5–3.0 | 38 | 22 |
| None | 0.5 | — | 100 | 2.5–3.0 | 38 | 28 |
| None | 0.5 | — | 100 | 2.5–3.0 | 38 | 28 |
| None | 0.5 | — | 100 | 2.5–3.0 | 38 | 28 |
| None | 0.5 | — | 92 | 2.5–3.0 | 30 | 22 |
| None | 3.0 | — | 104 | 2.5–3.0 | 108 | 72 |
| $NaAlO_2$ | 0.5 | 3.0 | 100 | 2.5–3.0 | 25 | 20 |
| $NaAlO_2$ | 0.5 | 3.0 | 92 | 2.5–3.0 | 18 | 14 |
| $NaAlO_2$ | 0.5 | 3.9 | 92 | 2.5–3.0 | 20 | 16 |
| $NaAlO_2$ | 3.0 | 2.8 | 104 | 2.4–3.0 | 120 | 70 |
| $NaAlO_2$ | 3.0 | 3.8 | 104 | 2.4–2.9 | 100 | 60 |
| $NaAlO_2$ | 3.0 | 3.9 | 104 | 2.5–3.0 | 42 | 38 |
| $NaAlO_2$ | 6.0 | 3.9 | 104 | 2.5–3.0 | 110 | 75 |

The results reported in Tables 1A and 1B above are considered to reflect the efficacy of the aqueous sodium aluminate as a neutralizing agent.

EXAMPLE 2

In a second series of tests, the efficacy of the sodium aluminate with respect to lowering the apparent acid dew point in the cold-end of the boiler systems was evaluated. Using a commercially available Land dew point meter, the condensation of a conducting film of sulfuric acid on a controlled temperature probe tip was detected by the onset of the flow of electric current between electrodes embedded in the tip. This permitted the determination of the acid dew point, and comparative rates of build-up directly on probe surfaces were obtainable from the rate of increase in current with time at any tip temperature. The results are reported in Tables 2A and 2B below. The feedrate of active additive and the boiler steam load are both expressed as pounds per hour, the dew points are expressed as degrees Farenheit (°F.) and the rates of acid build-up (RBU) are expressed as micro-amperes per minute ($\mu$ amp $min^{-1}$). Table 2A contains the results of the preliminary tests, and Table 2B contains the results of the confirming tests. The rate of acid build-up was determined only for a portion of the tests as indicated in the tables and was determined at a probe surface temperature of 230° F. for both tests.

TABLE 2A

| Additive | Feedrate (pph) | Steam Load (pph × $10^3$) | % $O_2$ | Dew point (° F) | RBU |
|---|---|---|---|---|---|
| None | — | 70 - 71 | 2.6 | 235 | 84 |
| None | — | 70 | 2.7 | 276 | 100 |
| $NaAlO_2$ | 4.3 | 70 | 2.7 | 268 | 40 |

TABLE 2B

| Additive | Feedrate (pph) | Steam Load (pph×$10^3$) | % $O_2$ | Dew point (° F) | RBU |
|---|---|---|---|---|---|
| None | — | 92 | 2.5–3.0 | 285 | 200 |
| None | — | 116 | 2.5–3.0 | 300 | 420–560 |
| $NaAlO_2$ | 3.0 | 92 | 2.5–3.0 | 260 | 25 |
| $NaAlO_2$ | 3.9 | 92 | 2.5–3.0 | 165 | 1 |
| $NaAlO_2$ | 3.0 | 116 | 2.5–3.0 | 275 | 60 → 0 |

The results reported in Tables 2A and 2B are considered to demonstrate the efficacy of the sodium aluminate both with respect to lowering the apparent acid dew point in the cold-end and with respect to decreasing the rate of acid build-up directly on surfaces in the cold-end. By lowering the apparent acid dew point, the chance of the acid condensing in the cold-end of the boiler system at a given temperature is decreased. Furthermore by lowering the apparent acid dew point in the cold-end, the combustion gas temperature can be lowered, resulting in an increase in boiler efficiency without a corresponding increase in corrosion of surfaces at the cold-end. The decrease in RBU which results from feeding the additive to the combustion gases indicates a decrease in the build-up of corrosive acid directly on the cold-end surfaces. The last RBU reported in Table 2B for 3 pounds per hour sodium aluminate at 116,000 pounds per hour steam load (60→0) is intended to indicate that an initial reading of 60 RBU was measured, but the reading decreased to 0. Apparent acid dew point is defined as that temperature at which an acid film contacts a surface, at the cold-end in this instance.

EXAMPLE 3

Using a portion of the washings obtained from the CERL probe described in Example 1 above, the efficacy of the aqueous sodium aluminate additive with respect to protecting cold-end surfaces against corrosion was evaluated. Since the iron (Fe) content of the washings indicated the amount of corrosion of the test surfaces exposed to the combustion gases, comparisons of the iron content of the washings provided a method of evaluating the efficacy of the inventive material. The results of these comparative tests are reported below in Tables 3A and 3B, with Table 3A containing the results of the preliminary tests and Table 3B containing the results of the confirming tests. In the preliminary tests, the probe was exposed to the combustion gases for 0.5 hour, and in the confirming tests the probe was exposed for the periods as indicated in Table 3B. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 3A

| Additive | Feedrate (pph) | Steam Load (pph X $10^3$) | % $O_2$ | Iron (ppm) 230° F | 250° F |
|---|---|---|---|---|---|
| None | — | 70 | 2.9 | 8 | 4 |
| $NaAlO_{A-}$ $_{lO_2}$ | 4.3 | 70 | 2.9 | 18 | 9 |

TABLE 3B

| Additive | Exposure (hours) | Feedrate (pph) | steam Load (pph×$10^3$) | % $O_2$ | Iron (ppm) 230° F | 250° F |
|---|---|---|---|---|---|---|
| None | 0.5 | — | 100 | 2.5–3.0 | 70 | 55 |
| None | 0.5 | — | 100 | 2.5–3.0 | 80 | 55 |
| None | 0.5 | — | 100 | 2.5–3.0 | 90 | 60 |
| None | 0.5 | — | 92 | 2.5–3.0 | 65 | 40 |
| None | 3.0 | — | 104 | 2.5–3.0 | 130 | 70 |
| None | 6.0 | — | 104 | 2.6–3.1 | 400 | 200 |
| $NaAlO_2$ | 0.5 | 3.0 | 100 | 2.5–3.0 | 15 | 10 |
| $NaAlO_2$ | 0.5 | 3.0 | 92 | 2.5–3.0 | 22 | 12 |
| $NaAlO_2$ | 0.5 | 3.9 | 92 | 2.5–3.0 | 20 | 10 |

TABLE 3B-continued

| Additive | Exposure (hours) | Feed-rate (pph) | steam Load (pph×10 $^3$) | % $O_2$ | Iron (ppm) 230° F | 250° F |
|---|---|---|---|---|---|---|
| $NaAlO_2$ | 3.0 | 3.9 | 104 | 2.5–3.0 | 30 | 20 |
| $NaAlO_2$ | 6.0 | 3.9 | 104 | 2.5–3.0 | 80 | 25 |

The results of Table 3A are considered inconclusive at best, due to, in the present inventor's opinion, the low corrosion rates which existed even in the absence of additive.

From the results reported in Table 3B, it can be seen that the corrosion was indeed effectively reduced; and these results are seen to indicate the efficacy of the individual additive in reducing the corrosion of surfaces exposed to combustion gases in the cold-end of a boiler system.

EXAMPLE 4

In addition to analyzing the washings from the CERL probe for iron content, the total solids content of each sample was also determined to evaluate the fouling tendencies of the sodium aluminate. While it is expected that an additive treatment at the cold-end of a boiler system would cause some fouling, the fouling should not be so severe as to outweigh the advantages of the additive. The test results are reported below in Tables 4A and 4B. In each of the preliminary tests, the results of which are reported in Table 4A, the probe was exposed to the combustion gases for a period of 0.5 hour; while in each of the confirming tests, the results of which are reported in Table 4B, the probe was exposed for a time period as indicated. The total solids are reported as parts of total solids per million parts of washing water at the probe surface temperatures indicated.

TABLE 4A

| Additive | Feed-rate (pph) | Steam Load (pph×10$^3$) | % $O_2$ | Total Solids (ppm) 230° F | 250° F | 300° F |
|---|---|---|---|---|---|---|
| None | — | 70 | 2.9 | 160 | 110 | 80 |
| $NaAlO_2$ | 4.3 | 70 | 2.9 | 340 | 300 | 270 |

4B

| Additive | Exposure (hours) | Feed-rate (pph) | Steam Load (pph × 10$^3$) | % $O_2$ | Total Solids (ppm) 230° F | 250° F | 300° |
|---|---|---|---|---|---|---|---|
| None | 0.5 | — | 92 | 2.5–3.0 | 520 | 280 | 50 |
| None | 3 | — | 104 | 2.5–3.0 | 1800 | 1300 | 150 |
| None | 6 | — | 104 | 2.6–3.1 | 3000 | 2000 | 400 |
| $NaAlO_2$ | 0.5 | 3.0 | 92 | 2.5–3.0 | 510 | 500 | 480 |
| $NaAlO_2$ | 0.5 | 3.9 | 92 | 2.5–3.0 | 480 | — | 610 |
| $NaAlO_2$ | 3 | 3.9 | 104 | 2.5–3.0 | 2600 | 2500 | 2100 |
| $NaAlO_2$ | 6 | 3.9 | 104 | 2.5–3.0 | 5200 | 5000 | 4800 |

Based on the results reported above in Tables 4A and 4B, the rate of solids deposition on the surfaces when the individual additive is used is considered to be acceptable overall, particularly since the deposits were easily removed.

EXAMPLE 5

In another series of tests, the CERL probe was exposed to the combustion gases for various periods of time, removed and visually inspected. The results are reported below in Table 5.

TABLE 5

| Additive | Exposure (hours) | Appearance of Probe |
|---|---|---|
| None | 0.5 | Green coating on cold-end of probe. |
| None | 3 | Heavy green coating on cold-end. |
| None | 6 | Very heavy green coating which was difficult to wash off. |
| $NaAlO_2$ | 0.5 | Substantially even white deposit. |
| $NaAlO_2$ | 3 | Moderate fluffy white deposit on leading and trailing edge, green strips between Deposits were easily removed, leaving tan undercoat. |
| $NaAlO_2$ | 6 | Same as 3 hours but with more deposit. |

Following are comparisons of the performances of sodium aluminate and alumina as cold-end additives. The comparison is based on apparent acid dew point, rate of acid build-up (RBU), acid deposition and corrosion inhibition. Although the tests were conducted in the same boiler system, the operating parameters were different, which latter fact will become apparent from the results reported in the following tables. Nonetheless, since the reported treatment level ranges overlap and are based on the amount of sulfur trioxide in the combustion gases, the present inventors consider these comparisons to be valid.

EXAMPLE 6

In a first comparison of the alumina and the sodium aluminate, the dew points and RBU's of the treatments were determined using a Land dew point meter as described in Example 2 above. In Table 6A, the results of tests using the sodium aluminate are reported; and in Table 6B, the results of tests using the alumina are reported. Since, as noted above, the treatment levels are based on the amount of sulfur trioxide in the combustion gases, the feed rates are expressed as pounds of active additive per pound of sulfur trioxide generated. For purposes of comparing the two additives, the reduction in dew point from control (no additive) and percent RBU of control (no additive) are reported, using average control values of dew point and RBU. The RBU's were measured at 230° F. throughout, except for the control runs in Table 6B, which were measured at 215–230° F.

TABLE 6A

| Additive | Feedrate | Steam Load (pph × 10$^3$) | % $O_2$ | Dew Point (° F) | RBU (μ amp min$^{-1}$) | Reduction in Dew Point from Average Control (° F) | Percent RBU of Average Control |
|---|---|---|---|---|---|---|---|
| None | — | 92 | 2.8 | 285 | 200 | — | — |
| None | — | 100 | 2.8 | 300 | — | — | — |
| None | — | 100 | 2.8 | — | 225 | — | — |
| None | — | 100 | 2.8 | 292 | 225 | — | — |

TABLE 6A-continued

| Additive | Feedrate | Steam Load (pph × $10^3$) | % $O_2$ | Dew Point (° F) | RBU (μ amp $min^{-1}$) | Reduction in Dew Point from Average Control (° F) | Percent RBU of Average Control |
|---|---|---|---|---|---|---|---|
| None | — | 100 | 2.8 | 304 | 150 | — | — |
| None | — | 104 | 2.8 | — | 200 | — | — |
| None | — | 104 | 2.8 | 295 | — | — | — |
| None | — | 104 | 2.8 | 300 | 200 | — | — |
| $NaAlO_2$ | .28 | 92 | 2.8 | 260 | 25 | 36 | 12.5 |
| $NaAlO_2$ | .36 | 92 | 2.8 | 165 | 1 | 131 | 0.5 |
| $NaAlO_2$ | .22 | 116 | 2.8 | 275 | 30 | 21 | 15.0 |

TABLE 6B

| Additive | Feedrate | Steam Load (pph × $10^3$ | % $O_2$ | Dew Point (° F | RBU (u amp $min^{-1}$ | Reduction in Dew Point from Average Control (° F) | Percent RBU of Average Control |
|---|---|---|---|---|---|---|---|
| None | — | 94 | 4.3 | — | 200 | — | — |
| None | — | 97 | 3.8 | 295 | 300 | — | — |
| None | — | 106 | 4.3 | 300 | 300 | — | — |
| $Al_2O_3$ | .08 | 70 | 6.2 | 287 | 150 | 10.5 | 56.4 |
| $Al_2O_3$ | .16 | 101 | 4.7 | 275 | — | 22.5 | — |
| $Al_2O_3$ | .22 | 78 | 5.8 | 250 | 110 | 47.5 | 41.3 |
| $Al_2O_3$ | .52 | 90 | 3.8 | 290 | 150 | 7.5 | 56.4 |

Based on the results reported above in Tables 6A and 6B, the sodium aluminate is considered to demonstrate enhanced results as a cold-end additive when compared to alumina.

EXAMPLE 7

In a second comparison of the alumina and the sodium aluminate, the acid depositions of the treatments were determined using a CERL probe as described in Example 1 above. In Table 7A, the results of tests using the sodium aluminate are reported; and in Table 7B, the results of tests using the alumina are reported. The feed rates are expressed as pounds of active additive per pound of sulfur trioxide generated. For purposes of treatment comparison, each treated value is compared to a corresponding control (no additive) value for the same steam load and the compared treated value is expressed as percent acid deposition of an average control value. The reported acid depositions are expressed as micrograms of sulfuric acid per minute per square inch (μg $H_2SO_4 min^{-1} in^{-2}$).

TABLE 7A

| Additive | Feedrate (pph) | Steam Load (pph × $10^3$) | % $O_2$ | Acid Deposition | Percent Acid Deposition of Average Control |
|---|---|---|---|---|---|
| None | — | 92 | 2.8 | 77 | — |
| None | — | 100 | 2.8 | 97 | — |
| None | — | 100 | 2.8 | 97 | — |
| None | — | 100 | 2.8 | 97 | — |
| None | — | 100 | 2.5 | 77 | — |
| None | — | 105 | 2.8 | 77 | — |
| $NaAlO_2$ | .28 | 92 | 2.8 | 49 | 56 |
| $NaAlO_2$ | .36 | 92 | 2.8 | 56 | 64 |
| $NaAlO_2$ | .26 | 100 | 2.8 | 70 | 80 |

TABLE 7B

| Additive | Feedrate (pph) | Steam Load (pph × $10^3$) | % $O_2$ | Acid Deposition | Percent Acid Deposition of Average Control |
|---|---|---|---|---|---|
| None | — | 83 | 5.8 | 156 | — |
| None | — | 101 | 2.8 | 164 | — |
| None | — | 105 | 3.4 | 200 | — |
| None | — | 105 | 4.3 | 184 | — |
| $Al_2O_3$ | .08 | 80 | 4.7 | 88 | 50 |
| $Al_2O_3$ | .16 | 101 | 3.3 | 92 | 52 |
| $Al_2O_3$ | .16 | 101 | 5.5 | 112 | 64 |
| $Al_2O_3$ | .20 | 80 | 5.3 | 70 | 40 |
| $Al_2O_3$ | .22 | 78 | 5.8 | 58 | 33 |
| $Al_2O_3$ | .54 | 86 | 5.3 | 84 | 48 |

Based on the results reported in Tables 7A and 7B, the performances of the sodium aluminate and alumina as neutralizing agents are considered to be comparable, with the alumina showing slightly greater activity.

EXAMPLE 8

In a third comparison of the alumina and the sodium aluminate, the corrosion reduction of the treatments were determined using a portion of the washings from a CERL probe as described in Example 3 above. The results are reported in Table 8A and 8B, with Table 8A containing the results of the tests using the sodium aluminate and Table 8B containing the results of the tests using the alumina. The measurement used for comparison was the amount of corrosion of the test probe which occurred in the presence of a given amount of acid (corrosion/acid) with the corrosion unit representing the iron concentration (in parts of iron per million parts of washing water) of the washings from one section (18.8 $in^2$) made up to 200 milliliters after 0.5 hour probe exposure, and with the acid unit representing the volume of 0.01 N NaOH needed to titrate a 50 milliliter aliquot of the same washings to the phenolphthalein end point. The feed rates are expressed as pounds of active additive per pound of sulfur trioxide generated.

TABLE 8A

| Additive | Feedrate | Corrosion/acid |
|---|---|---|
| None | — | 2.9 |
| None | — | 2.4 |
| $NaAlO_2$ | .26 | 0.5 |
| $NaAlO_2$ | .28–.36 | 1.6 |

TABLE 8B

| Additive | Feedrate | Corrosion/acid |
|---|---|---|
| None | — | 3.1 |
| None | — | 4.0 |
| $Al_2O_3$ | .08 | 3.8 |
| $Al_2O_3$ | .22 | 4.2 |
| $Al_2O_3$ | .54 | 2.5 |

Based on the results reported in Tables 8A and 8B, the sodium aluminate is considered to be more effective than alumina with respect to preventing corrosion.

Based on the results reported in Examples 6–8, above, the sodium aluminate is considered superior to the alumina as a cold-end additive.

EXAMPLE 9

The effects of the amine additive alone on acid deposition rates at various surface temperatures were determined using washings from a CERL probe as described in Example 1.

The results of these tests are reported in Tables 9A and 9B below in terms of acid deposition rate expressed as millimeters of 0.01 N NaOH needed to titrate one fourth of the amount of acid which deposited on 18.8 square inches ($in^2$) to the phenolphthalein end point. The feedrates reported are expressed as pounds of active additive per hour, and the steam loads reported are also expressed as pounds per hour. The % $O_2$ reported is the oxygen content of the combustion gases on a % volume basis. Table 9A contains the results of the preliminary tests, and Table 9B contains the results of the confirming tests. In the preliminary tests, the acid deposition rates at 220° F. were determined, while in the confirming tests the determinations were for acid deposition at 230° F. and 250° F. In the preliminary tests, the probe was exposed to the combustion gases for thirty minutes; while in the confirming tests, the probe was exposed for the time periods indicated.

TABLE 9A

| Additive | Feedrate (pph) | Steam Load (pph × $10^3$) | % $O_2$ | Acid Deposition 220° F |
|---|---|---|---|---|
| None | — | 50 | 2.75 | 10.5 |
| None | — | 56 | 3.0 | 13.0 |
| None | — | 56 | 2.9 | 14.0 |
| Naeea | 1.2 | 53 | 3.7 | 8.0 |
| Naeea | 3.4 | 50 | 3.8 | 5.5 |
| Naeea | 3.4 | 50 | 3.8 | 4.0 |

TABLE 9B

| Additive | Exposure Time (hrs) | Feedrate (pph) | Steam Load (pph × $10^3$) | % $O_2$ | Acid Deposition 250° F | Acid Deposition 230° F |
|---|---|---|---|---|---|---|
| None | 0.5 | — | 100 | 2.5–3.0 | 28 | 38 |
| None | 0.5 | — | 100 | 2.5–3.0 | 28 | 38 |
| None | 0.5 | — | 114 | 2.5–3.0 | 32 | 46 |
| None | 3.0 | — | 104 | 2.5–3.0 | 72 | 108 |
| Naeea | 0.5 | 2.8 | 100 | 2.5 | 9 | 12 |
| Naeea | 0.5 | 1.2 | 100 | 2.5 | 12 | 20 |
| Naeea | 3.0 | 3.05 | 104 | 2.5–3.0 | 64 | 76 |
| Naeea | 3.0 | 3.1 | 104 | 2.5–3.0 | 32 | 34 |
| Naeea | 0.5 | 4.1 | 114 | 2.5–3.0 | 10 | 10 |

From the results reported in Tables 9A and 9B it can be seen that the rate of acid deposition on the probe was reduced when the N-amino-ethyl ethanolamine alone was added to the combustion gases. This reduction in the acid deposition rate reflects the efficacy of the additive as a neutralizing agent.

EXAMPLE 10

In a second series of tests, the efficacy of the Naeea additive with respect to lowering the acid dew point in the cold-end of the boiler systems was evaluated using a commercially available Land dew point meter as described in Example 2. The results of these tests are reported in Tables 10A and 10B below. The feed rate of active additive and the boiler steam load are both expressed as pounds per hour, the dew points are expressed as degrees Farenheit (°F) and the rates of acid build-up (RBU) are expressed as micro-amperes per minute ($\mu$ amp $min^{-1}$). Table 10A contains the results of the preliminary tests, and Table 10B contains the results of the confirming tests. The rate of acid build-up was determined only for a portion of the tests as indicated in the Tables and was determined at a probe surface temperature of 230° F. for both tests.

TABLE 10A

| Additive | Feedrate (pph) | Steam Load (pph × $10^3$) | % $O_2$ | Dew Point (° F) | RBU |
|---|---|---|---|---|---|
| None | — | 50 | 3.75 | 273 | 110 |
| None | — | 50 | 3.75 | 278 | — |
| None | — | 50 | 3.75 | 277 | — |
| None | — | 53 | 4.1 | 270 | 140 |
| None | — | 53 | 4.1 | 270 | — |
| Naeea | 3.4 | 50 | 3.7 | 122 | 0 |
| Naeea | 3.4 | 50 | 3.7 | 121 | — |
| Naeea | 1.2 | 53 | 4.1 | 265 | 27 |
| Naeea | 1.2 | 53 | 4.1 | 266 | — |
| Naeea | 2.4 | 53 | 3.9 | 195 | 3 |
| Naeea | 2.4 | 53 | 3.9 | 191 | — |

TABLE 10B

| Additive | Feedrate (pph) | Steam Load (pph × $10^3$) | % $O_2$ | Dew Point (° F) | RBU |
|---|---|---|---|---|---|
| None | — | 100 | 2.5–3.0 | 300 | — |
| None | — | 100 | 2.5–3.0 | — | 225 |
| None | — | 100 | 2.5–3.0 | 292 | 225 |
| None | — | 100 | 2.5–3.0 | 304 | 150 |
| None | — | 100 | 2.5–3.0 | 294 | 250 |
| None | — | 104 | 2.5–3.0 | — | 200–300 |
| None | — | 104 | 2.5–3.0 | 295 | — |
| None | — | 104 | 2.5–3.0 | 300 | 200 |
| None | — | 114 | 2.5–3.2 | 293 | 400 |
| None | — | 124 | 2.5–3.0 | 296 | — |
| None | — | 124 | 2.5–3.0 | 300 | — |
| Naeea | 1.3 | 100 | 2.7 | 280 | — |
| Naeea | 3.1 | 101 | 2.5–2.7 | — | 12 |
| Naeea | 4.5 | 104 | 2.5–3.0 | 140 | — |
| Naeea | 3.8 | 104 | 2.5–3.0 | 155 | — |
| Naeea | 3.5 | 104 | 2.5–3.0 | 260 | — |
| Naeea | 3.1 | 104 | 2.5–3.0 | 180 | 8 |
| Naeea | 4.5 | 114 | 2.5–3.0 | 150 | — |
| Naeea | 2.1 | 114 | 2.5–3.0 | 290 | — |
| Naeea | 2.5 | 114 | 2.5–3.0 | 200 | — |
| None | — | 116 | 2.5–3.0 | 300 | 420–560 |
| Naeea | 1.3 | 116 | 2.5–3.0 | 300 | 300–500 |

From Tables 10A and 10B it can be seen that the alkanolamine alone is efficacious both with respect to lowering the acid dew point in the cold-end and with respect to decreasing the rate of acid build-up directly on surfaces in the cold end.

EXAMPLE 11

Using a portion of the washings obtained from the CERL probe described in Example 9 above, the efficacy of the alkanolamine additive alone with respect to protecting cold-end surfaces against corrosion was evaluated, using the method described in Example 3 above. The results of these comparative tests are reported below in Tables 11A and 11B, with Table 11A containing the results of the preliminary tests and Table 11B containing the results of the confirming tests. In the preliminary tests, the probe was exposed to the combustion gases for 0.5 hour, and in the confirming tests, the probe was exposed for the periods as indicated in Table 11B. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 11A

| Additive | Feedrate (pph) | Steam Load (pph × $10^3$) | % $O_2$ | Iron (ppm) 230° F | Iron (ppm) 250° F |
|---|---|---|---|---|---|
| None | — | 50 | 3.7 | 3 | 2 |
| Naeea | 3.4 | 50 | 3.8 | 2 | 3 |
| Naeea | 1.2 | 53 | 4.1 | 8 | 6 |

| Additive | Exposure (hours) | Feed-rate (pph) | Steam Load (pph × $10^3$) | % $O_2$ | Iron (ppm) 230° F | Iron (ppm) 250° F |
|---|---|---|---|---|---|---|
| None | 0.5 | — | 100 | 2.5–3.0 | 70 | 55 |
| None | 0.5 | — | 100 | 2.5 | 60 | 25 |
| None | 3 | — | 104 | 2.5–3.0 | 130 | 70 |
| None | 6 | — | 104 | 2.6–3.1 | 400 | 200 |
| Naeea | 0.5 | 2.8 | 100 | 2.5 | 12 | 10 |
| Naeea | 0.5 | 1.2 | 100 | 2.5 | 55 | 20 |
| Naeea | 3 | 3.05 | 104 | 2.5–3.0 | 40 | 35 |
| Naeea | 3 | 3.1 | 104 | 2.5–3.0 | 10 | 10 |
| Naeea | 6 | 3.1 | 104 | 2.5–3.1 | 25 | 25 |

The results of Table 11A are considered inconclusive, at best. It is the present inventors' opinion that the rather indifferent performance of the additive probably resulted from the low corrosion rates which existed even in the absence of additive.

From the results reported in Table 11B, it can be seen that the corrosion was indeed effectively reduced; and these results are seen to indicate the efficacy of the alkanolamine in reducing the corrosion of surfaces exposed to combustion gases in the cold-end of a boiler system.

EXAMPLE 12

In addition to analyzing the washings from the CERL probe for iron content, the total solids content of each sample was also determined to evaluate the fouling tendencies of the alkanolamine treatment. The results of these tests are reported below in Tables 12A and 12B. In each of the preliminary tests, the results of which are reported in Table 12A, the probe was exposed to the combustion gases for a period of 0.5 hour; while in each of the confirming tests, the results of which are reported in Table 12B, the probe was exposed for a time period as indicated. The total solids are reported as parts of total solids per million parts of washing water at the probe surface temperatures indicated.

TABLE 12A

| Additive | Feed-rate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|
| None | — | 50 | 3.7 | 100 | 60 | 40 |
| Naeea | 3.4 | 50 | 3.8 | 170 | 80 | 180 |
| Naeea | 1.2 | 53 | 4.1 | 140 | 150 | 80 |

TABLE 12B

| Additive | Exposure Time (hours) | Feedrate (pph) | Steam Load (pph × $10^3$) | % $O_2$ | Total Solids 230° F | Total Solids 250° F | Total Solids 300° F |
|---|---|---|---|---|---|---|---|
| None | 0.5 | — | 100 | 2.5 | 460 | 250 | 75 |
| None | 3 | — | 104 | 2.5–3.0 | 1800 | 1300 | 150 |
| None | 6 | — | 104 | 2.6–3.1 | 3000 | 2000 | 400 |
| Naeea | 0.5 | 2.8 | 100 | 2.5 | 360 | 270 | 180 |
| Naeea | 0.5 | 1.2 | 100 | 2.5 | 340 | 220 | 80 |
| Naeea | 3 | 3.05 | 104 | 2.5–3.0 | 1200 | 1000 | 850 |
| Naeea | 3 | 3.1 | 104 | 2.5–3.0 | 750 | 650 | 450 |
| Naeea | 6 | 3.1 | 104 | 2.5–3.1 | 2600 | 2400 | 1400 |

Based on the results reported above in Tables 12A and 12B, the rate of solids deposition on the surfaces when the alkanolamine is used is considered to be exceptional.

EXAMPLE 13

In another series of tests, the CERL probe was exposed to the combustion gases for various periods of time, removed and visually inspected. The results are reported below in Table 13.

TABLE 13

| Additive | Exposure (hours) | Appearance of Probe |
|---|---|---|
| None | 0.5 | Green coating on cold-end of probe. |
| None | 3 | Heavy green coating on cold-end. |
| None | 6 | Very heavy green coating on cold-end, which coating |
| Naeea | 0.5 | Clean, glossy. |
| Naeea | 3 | No apparent build-up. Slightly tacky. Easily washed |
| Naeea | 6 | Shiny. Soot on leading edge. Sticky at cold-end. Easily washed. |

Having thus established the efficacy of the sodium aluminate and the alkanolamine as cold-end additives, individually, the present inventors were desirous of determining whether or not an additive composition comprising sodium aluminate and alkanolamines combined was efficacious. Indeed, it is considered highly desirable to be able to combine the individual additives on an optimized cost basis. Furthermore, depending on the particular problem to be treated, it may be desirable to combine the additives to take advantage of the relative strengths of each and/or to possibly supplement the relative weakness(es) of each.

EXAMPLE 14

Using the same test procedures as described in Examples 1 and 9, with respect to the confirming tests, above, and using the additives described therein but in combination, the effect of the combined treatment on acid deposition was evaluated. The results of this test are reported below in Table 14 in terms of acid deposition rate expressed as milliliters of 0.01N NaOH needed to titrate one-fourth of the amount of acid which deposited on 18.8 square inches ($in^2$) to the phenolphthalein end point. The feedrates reported are expressed as pounds of active additive per hour, and the steam loads reported are also expressed as pounds per hour. The % $O_2$ reported is the oxygen content of the combustion gases on a % volume basis.

TABLE 14

| Additive | Exposure (hrs) | Feedrate (pph) | Steam Load (ppm × $10^3$) | % $O_2$ | Acid Deposition 230° F | Acid Deposition 250° F |
|---|---|---|---|---|---|---|
| None | 0.5 | — | 100 | 2.5–3.0 | 38 | 28 |
| None | 0.5 | — | 100 | 2.5–3.0 | 38 | 28 |
| None | 0.5 | — | 100 | 2.5–3.0 | 38 | 28 |
| Naeea + $NaAlO_2$ | 0.5 | 0.9 + 3.7 | 100 | 2.5–3.0 | 14 | 12 |

EXAMPLE 15

Using the same test procedures as described above in Examples 2 and 10 with respect to the confirming tests, and using the additives described therein but in combination, the efficacy of the combined treatment with respect to lowering the acid dew point and rate of acid build-up in the cold-end of a boiler system was evaluated. The results are reported in Table 15 below. The feed rate of active additive and the boiler steam load are both expressed as pounds per hour, the dew points are expressed as degrees Farenheit (°F) and the rates of acid build-up (RBU) are expressed as micro-amperes per minute ($\mu$ amp $min^{-1}$).

TABLE 15

| Additive | Feedrate (pph) | Steam Load (pph × $10^3$) | % $O_2$ | Dew Point (° F) | RBU |
|---|---|---|---|---|---|
| None | — | 100 | 2.5–3.0 | — | 225 |
| None | — | 100 | 2.5–3.0 | 292 | 225 |
| None | — | 100 | 2.5–3.0 | 304 | 150 |
| None | — | 100 | 2.5–3.0 | 294 | 250 |
| Naeea $NaAlO_2$ | 0.9 + 3.7 | 100 | 2.5–3.0 | 160 | 0 |

EXAMPLE 16

Using the same test procedures as described above in Examples 3 (with respect to the confirming tests) and 11, and using the additives described therein but in combination, the efficacy of the combined treatment with respect to protecting cold-end surfaces against corrosion was evaluated. The results of these tests are reported below in Table 16. The steam loads and active additive are expressed as pounds per hour (pph), the oxygen content of the combustion gases as percent oxygen (% $O_2$) by volume, and the iron content as parts of iron per million parts of washing liquid at the probe temperatures indicated.

TABLE 16

| Additive | Exposure (hrs) | Feedrate (pph) | Steam Load (pph × $10^3$) | % $O_2$ | Iron (ppm) 230 ° F | Iron (ppm) 250 ° F |
|---|---|---|---|---|---|---|
| None | 0.5 | — | 100 | 2.5–3.0 | 70 | 55 |
| None | 0.5 | — | 100 | 2.5–3.0 | 80 | 55 |
| None | 0.5 | — | 100 | 2.5–3.0 | 90 | 60 |
| None | 0.5 | — | 100 | 2.5–3.0 | 90 | 60 |
| Naee + $NaAlO_2$ | 0.5 | 0.9 + 3.7 | 100 | 2.5–3.0 | 20 | 12 |

EXAMPLE 17

In addition to analyzing the washings from the CERL probe for iron content as reported in Example 16, the total solids content of each sample was also determined to evaluate the fouling tendencies of the combined treatment. The results are reported below in Table 17. The total soilds are expressed as parts of total solids per million parts of washing water at the probe surface temperatures indicated.

TABLE 17

| Additive | Exposure (hrs) | Feedrate (pph) | Steam Load (pph × $10^3$) | % $O_2$ | Total Solids (ppm) 230° F | Total Solids (ppm) 250° F | Total Solids (ppm) 300° F |
|---|---|---|---|---|---|---|---|
| None | 0.5 | — | 100 | 2.5–3.0 | 500 | 380 | 200 |
| None | 0.5 | — | 100 | 2.5–3.0 | 520 | 320 | 110 |
| None | 0.5 | — | 100 | 2.5–3.0 | 520 | 390 | 100 |
| None | 0.5 | — | 100 | 2.5–3.0 | 570 | 390 | 300 |
| Naee + $NaAlO_2$ | 0.5 | 0.9 + 3.7 | 100 | 2.5–3.0 | 900 | 900 | 900 |

Based on the results reported above in Tables 1–13, which are seen to clearly demonstrate the efficacy of the sodium aluminate and the alkanolamine, individually, as cold-end additives, and the results reported in Tables 14–17, a treatment composition comprising sodium aluminate and an alkanolamine is considered to have efficacy as a cold-end additive.

Having thus described the invention, what is claimed is:

1. A method of reducing the amount of sulfur trioxide condensation on, and therefore the amount of sulfuric acid corrosion of, metal parts at the cold-end of a combustion system in contact with combustion gases derived from the combustion of sulfur-containing fuel which combustion gases flow along a path at the cold-end of the combustion system from a first zone of relative turbulence to a second zone at which the turbulence subsides, said method comprising:

adding to the combustion gases at the cold-end of the combustion system and at said zone of turbulence an effective amount for the purpose of an aqueous solution of sodium aluminate and N-aminoethyl ethanolamine such that the additive will travel along with the gases as solids, vapor, and/or liquid droplets from said zone of turbulence to said second zone and deposit on surfaces of said metal parts.

2. The method of claim 1, wherein the additive is sprayed into the combustion gases.

3. The method of claim 1, wherein the combustion system is a steam generating system, and wherein the fuel is sulfur-containing oil.

4. The method of claim 3, wherein the additive is sprayed into the combustion gases.

5. The method of claim 1, wherein the sodium aluminate is added in an amount of from about 0.2 to about 0.9 pound of sodium aluminate per pound of sulfur trioxide generated upon combustion of the fuel, and wherein the alkanolamine is added in an amount of from about 0.1 to about 0.8 pound of alkanolamine per pound of sulfur trioxide generated, with the proviso that the total treatment level does not exceed about 1.0 pound per pound of sulfur trioxide generated.

6. The method of claim 5, wherein the sodium aluminate is added in an amount of from about 0.25 to about 0.75 pound per pound of sulfur trioxide generated, and wherein the alkanolamine is added in an amount of from about 0.25 to about 0.75 pound per pound of sulfur trioxide generated, with the proviso that the total treatment level does not exceed about 1.0 pound per pound of sulfur trioxide generated.

7. The method of claim 1, wherein the temperature of the combustion gases at the time of addition is from about 250° F. to about 675° F.

8. The method of claim 7, wherein the temperature of the combustion gases at the time of addition is from about 350° F. to about 650° F.

9. The method of claim 1, wherein the additive is fed in droplet form to the combustion gases 10. The method of claim 2, wherein the additive is sprayed into the combustion gases.

11. The method of claim 2, wherein the droplets have a size of less than about 360 microns.

12. The method of claim 11, wherein the droplets have a size of less than about 260 microns.

* * * * *